US007926428B2

(12) United States Patent
Schorr et al.

(10) Patent No.: US 7,926,428 B2
(45) Date of Patent: Apr. 19, 2011

(54) RAILWAY TRUCK WITH BEARING ADAPTER

(75) Inventors: Ralph H. Schorr, Madison, IL (US); Peter Klauser, Will, IL (US); Jay P. Monaco, Madison, IL (US); Gnana Jeevan Robinson, Chester, PA (US); Manuel Tavares, Chester, PA (US)

(73) Assignee: Amsted Rail Company, Inc., Chicago, IL (US)

( * ) Notice: Subject to any disclaimer, the term of this patent is extended or adjusted under 35 U.S.C. 154(b) by 295 days.

(21) Appl. No.: 12/283,688

(22) Filed: Sep. 16, 2008

(65) Prior Publication Data

US 2010/0064930 A1 Mar. 18, 2010

(51) Int. Cl.
*B61F 5/26* (2006.01)

(52) U.S. Cl. ..... 105/224.1; 105/223

(58) Field of Classification Search ..... 105/218.1–225
See application file for complete search history.

(56) References Cited

U.S. PATENT DOCUMENTS

| | | | | |
|---|---|---|---|---|
| 3,699,897 | A * | 10/1972 | Sherrick | 105/218.1 |
| 5,081,935 | A * | 1/1992 | Pavlick | 105/224.1 |
| 6,591,759 | B2 * | 7/2003 | Bullock | 105/224.1 |
| 2007/0084377 | A1 * | 4/2007 | Myers | 105/218.1 |

FOREIGN PATENT DOCUMENTS

GB 2035238 A * 6/1980

* cited by examiner

*Primary Examiner* — S. Joseph Morano
*Assistant Examiner* — Zachary Kuhfuss
(74) *Attorney, Agent, or Firm* — Edward J. Brosius

(57) ABSTRACT

A railway car truck is provided that includes two sideframes and a bolster. Each sideframe has a pedestal opening at each end to receive a bearing adapter assembly. The pedestal opening is formed by a roof section that includes a pad receiving opening. The bearing adapter assembly includes a cast steel bearing adapter that is formed to fit on top of a bearing assembly. An adapter pad, comprised of a selected hardness elastomer, is fit on top of the bearing adapter. The adapter pad includes a base section and a raised top section that is fit within the pad receiving opening in the pedestal roof section.

16 Claims, 4 Drawing Sheets

RAILWAY TRUCK WITH BEARING ADAPTER

BACKGROUND OF THE INVENTION

The present invention relates to a railway freight car truck and, more particularly, to an improved bearing adapter for use in the pedestal jaw opening of the sideframe of a railway freight car truck.

In a railway freight car truck, two axles are held in a pair of laterally spaced sideframes, with a bolster extending laterally between and supported on each sideframe. The wheels are press fit on the axles, with the ends of the axles also fitted with a roller bearing assembly. The roller bearing assembly itself is fit into a bearing adapter that is fit into a pedestal jaw opening at the longitudinal end of each sideframe. The ends of the bolsters are themselves supported on spring groups, which spring group can be directly supported on the lower portion of the center openings of the sideframes or which can be directly supported on a transom which in turn is fitted on the center opening of the sideframes. Such a railway truck is shown in U.S. Pat. No. 5,222,441, the disclosure of which is incorporated by reference.

U.S. Pat. No. 5,562,045, the disclosure of which is incorporated by reference, discloses an adapter and pad assembly useful in the fitting of the bearing assembly into the pedestal jaw opening of each sideframe. The bearing adapter, which is itself fit on top of the bearing assembly, is comprised of a unitary steel or iron piece. This piece includes shoulders that are laterally spaced to form a receiving opening at each longitudinal edge of the bearing adapter. An elastomeric adapter pad is fitted on top of the bearing adapter. The adapter pad itself is disclosed to be comprised of an injection molded polymer or a castable polyurethane. The adapter pad itself includes depending legs which extend from opposite longitudinal edges of the adapter pad. The depending legs are spaced laterally at each longitudinal edge of the adapter pad such that the depending legs are received in openings between the laterally spaced shoulders of the bearing adapter.

Accordingly, it is an object of the present invention to provide an improved bearing adapter and adapter pad for use in a railway truck sideframe pedestal opening.

It is another object of the present invention to provide an improved bearing adapter and adapter pad for use in a railway car truck utilizing a transom bolster and spring support system.

SUMMARY OF THE INVENTION

A railway freight car truck of the so-called three piece standard design, is comprised of two laterally spaced, unitary cast steel sideframes and a laterally extending bolster, also of a unitary cast steel structure. The ends of the bolster are received and supported on spring groups that themselves are supported on the bottom section of a bolster opening in each sideframe. A variation of a three piece railway freight car truck utilizes a transom running laterally beneath the bolster. The transom ends are supported in the sideframe openings and each spring group is in turn supported in the transom ends. Each end of the bolster is supported in a spring group.

The wheel axle assemblies themselves are received in openings, commonly referred to as pedestal jaw openings, at longitudinal ends of each sideframe. The wheel axle assemblies themselves extend laterally between the sideframes, and hence, also laterally between the two spaced railway tracks.

For improved performance of the railway freight car truck, it is desirable to receive the bearings press fit on each axle end into a bearing adapter assembly.

In one embodiment, the improved bearing adapter assembly is comprised of a cast steel, unitary bearing adapter. This bearing adapter includes lateral edges themselves having arcuate cutouts to be placed over the bearing assembly. The bearing adapter further comprises depending shoulders that extend from each longitudinal edge of the bearing adapter. The shoulders at each longitudinal edge of the bearing adapter themselves are laterally spaced to form an opening there between. Further, the bearing adapter embodiment may include raised lateral edges that extend longitudinally and are spaced laterally across the top section of the bearing adapter. It should be understood that the top section of such bearing adapter is generally rectangular in structure.

In one embodiment, the improved adapter pad is comprised of an improved elastomer or polymer, usually polyurethane. Such improved adapter pad is usually formed in a casting operation, although recent improvements have allowed the improved adapter pad to also be formed in an injection molding operation. The adapter pad itself is seen to be comprised of a generally rectangular base section, with depending legs extending from each longitudinal edge thereof. The depending legs are spaced laterally on each longitudinal edge. Such depending legs are fit downwardly into the opening in the bearing adapter and abut the shoulders of the bearing adapter to provide lateral support for the adapter pad. The adapter pad also includes a raised top section that extends upwardly from the base section.

Further, the adapter pad may include laterally extending projections extending outwardly from lateral edges of the base section of the adapter pad. Such adapter pad projections are positioned opposite the raised lateral edges of the bearing adapter. The interface and possible contact of the laterally extending projection of the adapter pad and the raised lateral edges of the bearing adapter act to limit any lateral movement of the adapter pad.

DETAILED DESCRIPTION OF THE INVENTION

Figure 1:
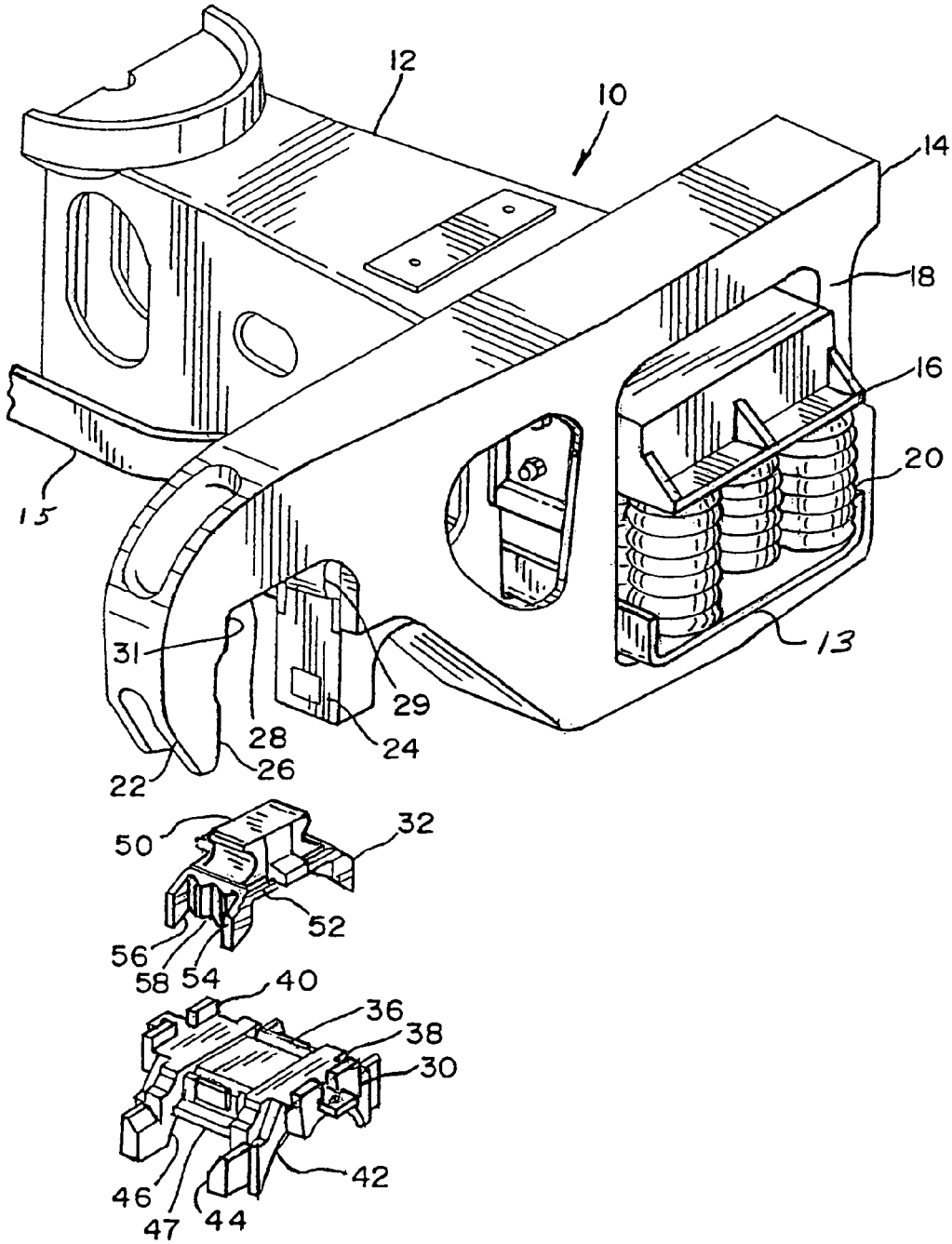
FIG. 1 is a partial perspective view of a sideframe, bolster, transom and bearing adapter and adapter pad.

Referring now to FIG. 1 of the drawings, a three piece railway truck is shown generally at 10. Bolster 12 extends laterally between two sideframes 14. Each sideframe 14 includes a bolster opening 18 through which end 16 of bolster 12 extends. Transom 15 is a generally flat elongated, unitary steel structure that extends laterally beneath bolster 12 and has ends 13 that extends with bolster openings 18 in sideframe 14. Spring group 20 is supported on transom ends 13 and, in turn, supports bolster 12.

Lateral end of each sideframe 14 is seen to be comprised of a downwardly extending pedestal jaw 22. The inside wall 26 of pedestal jaw 22, along with roof section 28 and vertical face 24 are seen to combine to form the pedestal jaw opening. Roof section 28 includes a receiving opening 31. At the interface between vertical face 24 and roof section 28, there is seen to be an inner thrust lug 29. Inner thrust lug 29 is seen to comprise an angled section that extends from an upper section of vertical face 24 to an inward section of roof section 28. Similarly, but not entirely seen in this perspective view of FIG. 1, outer thrust lug 31 is seen to comprise an angled section extending from an upper portion of inside wall 26 extending to an inner portion of roof section 28.

Referring now to FIG. 1, the partial perspective view of the main components of a railway freight car truck are shown generally at 10. Such components include bolster 12, which is generally a cast steel unitary structure, that extends laterally between two sideframes 14. Sideframes 14 are also unitary steel or iron structures. Sideframes 14 are seen to extend longitudinally and parallel with the railway tracks. Each sideframe 14 includes a bolster opening 18 through which end 16 of bolster 12 extends. End 16 of bolster 12 is supported on spring group 20, which itself is supported on a transom 15.

Another part of the present invention includes bearing adapter 30, which is seen to be a generally rectangular structure having depending legs extending therefrom. Bearing adapter 30 is usually comprised of a unitary steel or iron structure. Adapter pad 32 is also seen to be a generally rectangular structure with depending legs extending therefrom. Adapter pad 32 is usually comprised of a cast or injection molded polymer or elastomer, which will be further described.

Bearing adapter 30 is seen to be comprised of a unitary, steel or iron structure that is generally rectangular in shape. Bearing adapter 30 is comprised of a generally rectangular top section 36, which is seen to be generally flat. Two raised edge supports 38 are seen to extend upwardly from the lateral edges of bearing adapter 30, as are similar raised edge supports 40 from the opposite lateral edge of bearing adapter 30. The combined raised edge supports 38 and 40 form a receiving surface and pocket for adapter pad 32. Bearing adapter 30 is also seen to comprise an arcuate opening 42 on each lower lateral edge; this arcuate opening 42 is adapted to seat against a bearing, which is not shown in this view. Bearing adapter 30 is also seen to comprise four depending shoulders, of which 44 and 46 are shown in this view. Depending shoulders 44 and 46 are seen to be laterally spaced, forming an opening for the adapter pad structure.

Adapter pad 32 is usually comprised of a cast polymer, polyurethane or elastomeric material and is of unitary structure. It is also possible to construct adapter pad 32 with a blown injection method, but casting is the preferred method of forming adapter pad 32. Adapter pad 32 is comprised of a generally rectangular and base section 52, with lateral edges, is a raised top section 50, which is generally rectangular, extend upwardly from base section 52. Four depending legs, of which depending leg 54 and 56 are shown in this view, are seen to extend downwardly, and form a thrust lug opening 58 there between. A similar thrust lug opening is formed on the other longitudinal edge of adapter pad 32. In assembling adapter pad 32 onto the top of bearing adapter 30, it can be seen that depending legs 54 and 56 project downwardly and are supported laterally against depending shoulders 44 and 46, respectively, of bearing adapter 30. Raised top section 50 is designed to be received, at least partially, into receiving opening of roof section 28 of pedestal jaw 22.

Figure 2:
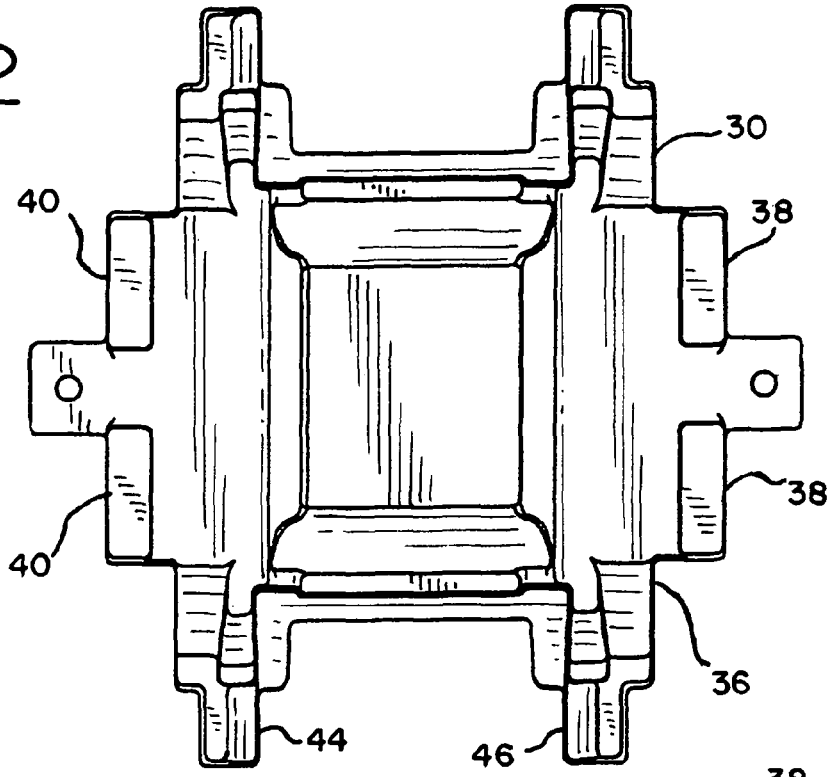
FIG. 2 is a top view of a first embodiment of a bearing adapter in accordance with the present invention.
Figure 3:
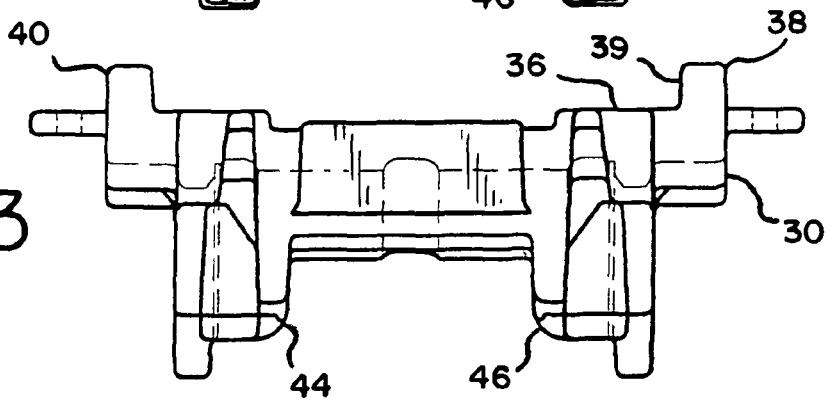
FIG. 3 is an end view of the first embodiment of a bearing adapter in accordance with the present invention.
Figure 4:
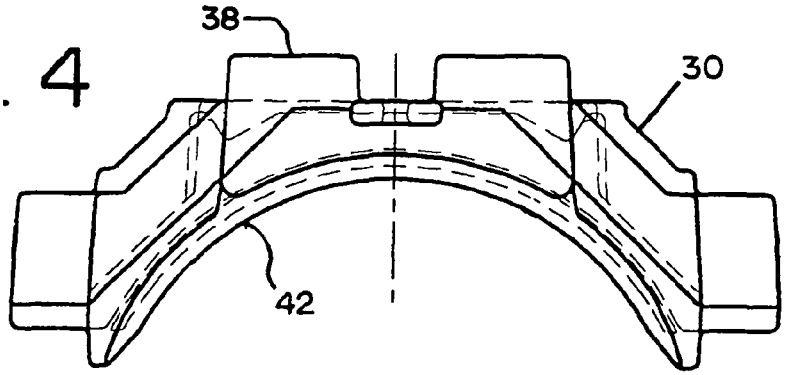
FIG. 4 is a side view of the first embodiment of a bearing adapter in accordance with the present invention.

Referring now to FIGS. 2-4, detailed views of bearing adapter 30 shown in FIG. 1 are provided. Bearing adapter 30, as described above in FIG. 1, is seen to include a generally rectangular top section 36, with raised edge supports 38 and 40, extending upwardly from the lateral edges of bearing adapter 30. Arcuate opening 42 is also seen to be formed in lateral edges of bearing adapter 30 to allow fitting of bearing adapter 30 on top of a bearing assembly. Depending shoulders 44 and 46 are seen to extend downwardly from opposite longitudinal ends of bearing adapter 30, and depending shoulders 44 and 46 are seen to be spaced laterally from each other, forming opening 47.

Figure 5:
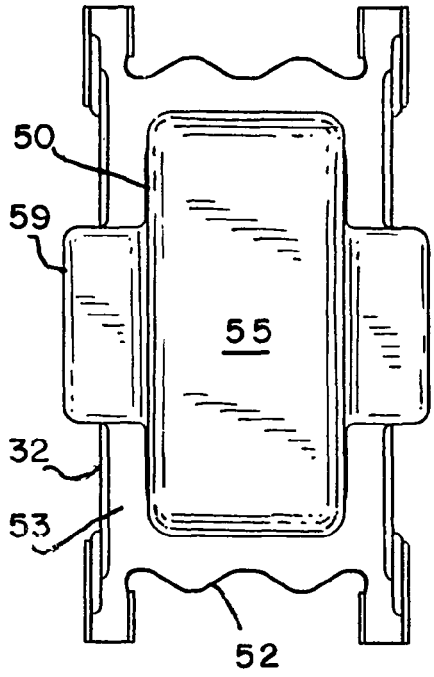
FIG. 5 is a top view of an adapter pad in accordance with the present invention.
Figure 6:
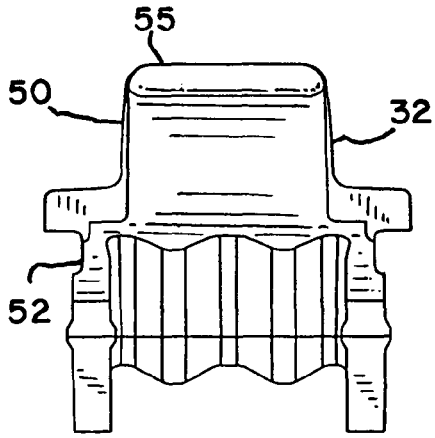
FIG. 6 is an end view of an adapter pad in accordance with the present invention.
Figure 7:
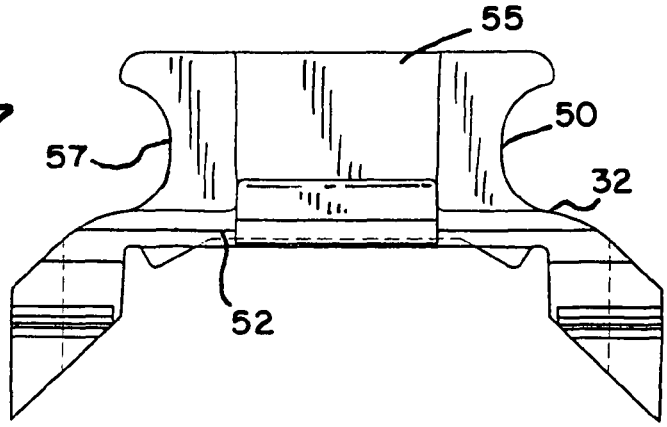
FIG. 7 is a side view of an adapter pad in accordance with the present invention.

Referring now to FIGS. 5, 6 and 7, detailed views of adapter pad 32 are provided. Adapter pad 32 is seen to be a generally rectangular structure of a polymer, polyurethane, or elastomeric material. Adapter pad 32 is comprised of a generally rectangular base section 52, with a centrally located, raised top section 50 extending upwardly from a surface 53 of base 145 section 52. Raised top section 50 includes a generally flat top surface 55. Raised top section 50 may include indented section 57 at either longitudinal end. Such an indented a hourglass shape with provide more longitudinal flexibility in adapter pad 32 while providing greater lateral stability as the lateral walls would not include such an indented shape, at least in the one embodiment being described.

Adapter pad 32 also includes, in this embodiment, two side sections 59 that extend laterally from the lateral lower edges of raised top section 50. Each side section 59 is positioned opposite an internal surface 39 of a raised edge support 38 of bearing adapter 30. Such positioning acts to limit the lateral movement of adapter pad 32 on bearing adapter 30.

Raised top section 50 of adapter pad 32 extends upward from base section 52 for at least 33% of the entire height of adapter pad 32, in the embodiment.

Vertical compression of adapter pad 32 is designed by the configuration and material to minimize the cold flow or creep of adapter pad 32. Creep means herein the continuing compression over time when under load.

Adapter pad 32 is also designed by a selection of shape, height and material to allow sideframe 14 to roll or sway, which, in the railway freight car truck arrangement of FIG. 1, is a benefit of the truck design and configuration using the transom. Such allowance contributes to the controlled steering capability of the railway truck.

The longitudinal stiffness of adapter pad 32 in a preferred embodiment is just below about 30 KIPS/Inch.

Figure 8:
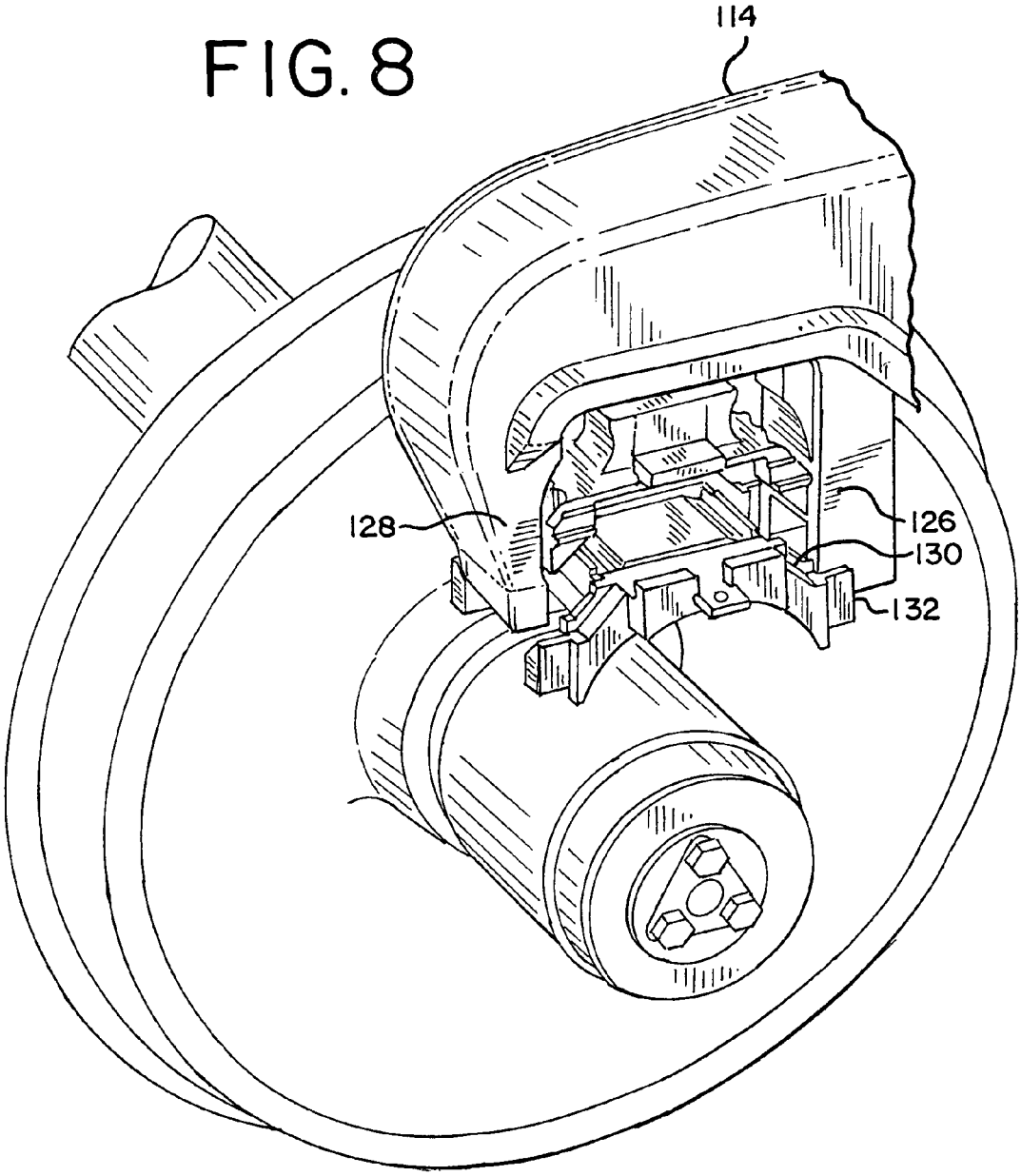
FIG. 8 is an end view of second embodiment of a bearing adapter and adapter pad in accordance with the present invention.

In viewing FIG. 8, a bearing adapter and adapter pad arrangement similar to FIG. 1 is shown. However, bearing adapter 130 includes end tabs 132 that extend outwardly longitudinally from the lateral edge of bearing adapter 130. Such end tabs 132 are designed to engage complementary surfaces on the pedestal jaw 128 inside wall 126 of side frame 114. Such engagement limits the amount of roll of side frame 114.

What is claimed is:

1. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a bearing adapter received in each pedestal opening, each bearing adapter comprising a generally rectangular center section having a top surface, and lateral end sections each forming a concave opening to receive a bearing, each bearing adapter having a longitudinally spaced end sections, each end section forming a generally rectangular opening, each generally rectangular opening formed by a laterally extending adapter wall end and two laterally spaced, depending adapter shoulders, an adapter pad mounted on top of the bearing adapter, the adapter pad comprising a base section, a generally rectangular raised top section that extends laterally for less than the lateral width of the base section of the adapter pad and longitudinally for less than the longitudinal length of the base section of the adapter pad, and two pair of depending legs that extend downwardly from each longitudinal end of the adapter pad, and the pair of adapter pad legs at each longitudinal end of the adapter pad received in the generally rectangular opening at each longitudinal end of the bearing adapter, wherein the lower leg portion has tabs which extend longitudinally from the bearing adapter a distance sufficient to control the amount of roll of the side frame.

2. The railway car truck of claim 1 wherein the base section of the adapter pad includes two side sections with each side section extending laterally, wherein each bearing adapter includes two support edges, each support edge extending upwardly from the top surface of the bearing adapter, and wherein each side section of the base section of the adapter pad is positioned opposite an internal surface of a support edge of the bearing adapter to secure the adapter pad.

3. The railway car truck of claim 1 wherein the adapter pad raised top section extends upwardly from the base section for at least 33% of the entire height of the adapter pad.

4. The railway car truck of claim 1 wherein the adapter pad is comprised of an elastomer polymer blend and a unitary structure.

5. The railway car truck of claim 1 wherein the raised top section of the adapter pad extends upwardly from the base section of the adapter pad a distance sufficient to allow the railway truck to steer.

6. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, each roof section having a pad receiving opening formed therein, a bearing adapter received in each pedestal opening, each bearing adapter comprising a generally rectangular center section having a top surface, and lateral end sections each forming a concave opening to receive a bearing, each bearing adapter having longitudinally spaced end sections, each end section forming a generally rectangular opening, each generally rectangular opening formed by a laterally extending adapter wall end and two laterally spaced, depending adapter shoulders, an adapter pad mounted on top of the bearing adapter, the adapter pad comprising a base section and a raised top section that extends laterally for less than the lateral width of the base section, and longitudinally for less than the longitudinal length of the base section, and wherein the raised top section of the adapter pad fits in the pad receiving opening of the roof section of the pedestal opening, wherein the lower leg portion has tabs which extend longitudinally from the bearing adapter a distance sufficient to control the amount of roll of the side frame.

7. The railway car truck of claim 6 wherein the base section of the adapter pad includes two side sections, with each side section extending laterally, and wherein each bearing adapter includes two support edges, each support edge extending upwardly from the top surface of the bearing adapter, and wherein each side section of the base section of the adapter pad is positioned opposite and internal surface of a support edge of the bearing adapter to limit any lateral movement of the adapter pad.

8. The railway car truck of claim 6 wherein the adapter pad raised top section extends upwardly from the base section for at least 33% of the entire height of the adapter pad.

9. The railway car truck of claim 6 wherein the adapter pad is comprised of an elastomer polymer blend and is a unitary structure.

10. The railway car truck of claim 6 wherein the raised top section of the adapter pad extends upwardly from the base section of the adapter pad a distance sufficient to allow the railway truck to steer.

11. A railway car truck comprising two sideframes, a bolster, a transom and two spring groups, each sideframe including a support channel, the transom having two ends that each extends into and are supported on the support channel of a sideframe, each spring group being located and supported on a top surface of the end of the transom, and the bolster having two ends that each extends into and is supported on a spring group, each sideframe having a pedestal opening at each end, each pedestal opening formed by a laterally outboard pedestal jaw, a laterally inboard vertical face and a roof section extending between the pedestal jaw and the vertical face, a bearing adapter received in each pedestal opening, each bearing adapter comprising a generally rectangular center section having a top surface and lateral end sections each forming a concave opening to receive a bearing, each bearing adapter having longitudinally spaced end sections, each end section forming a generally rectangular opening, each generally rectangular opening formed by a laterally extending adapter wall end and two laterally spaced, depending adapter shoulders, an adapter pad mounted on top of the bearing adapter, the adapter pad comprising a base section and a raised top section that extends laterally for less than the lateral width of the base section of the adapter pad, and longitudinally for less than the longitudinal length of the base section of the adapter pad, and two pair of depending legs that extend downwardly from each longitudinal end of the adapter pad, and the pair of adapter pad legs at each longitudinal end of the adapter pad received in the generally rectangular opening at each longitudinal end of the bearing adapter, wherein the lower leg portion has tabs which extend longitudinally from the bearing adapter a distance sufficient to control the amount of roll of the side frame.

12. The railway car truck of claim 11 wherein each pedestal opening roof section has a pad receiving opening formed therein, and the raised top section of the adapter pad fits in the pad receiving opening of the pedestal opening roof section.

13. The railway car truck of claim 11 wherein the base section of the adapter pad includes two side sections, with each side section extending laterally, and wherein each bearing adapter includes two support edges, each support edge extending upwardly from the top surface of the bearing adapter, and wherein each side section of the base section of the adapter pad is positioned opposite an internal surface of a support edge of the bearing adapter to limit any lateral movement of the adapter pad.

14. The railway car truck of claim 11 wherein the adapter pad raised top section extends upwardly from the base section for at least 33% of the entire height of the adapter pad.

15. The railway car truck of claim 11 wherein the adapter pad is comprised of an elastomer polymer blend and is a unitary structure.

16. The railway car truck of claim 11 wherein the raised top section of the adapter pad extends upwardly from the base section of the adapter pad a distance sufficient to allow the railway truck to steer.

* * * * *